US009066638B2

(12) United States Patent
Lowery et al.

(10) Patent No.: US 9,066,638 B2
(45) Date of Patent: Jun. 30, 2015

(54) INSERT FOR USE WITH A ROLL OF WEB MATERIAL, AND PROVIDING A UNIQUE IDENTIFIER FOR THE ROLL OF WEB MATERIAL

(75) Inventors: Morgan J. Lowery, Deforest, WI (US); Gregory J. Hallingstad, Madison, WI (US); Michael J. Pelland, Princeton, WI (US); Steven R. Reckamp, Crystal Lake, IL (US)

(73) Assignee: San Jamar, Inc., Elkhorn, WI (US)

( * ) Notice: Subject to any disclaimer, the term of this patent is extended or adjusted under 35 U.S.C. 154(b) by 54 days.

(21) Appl. No.: 13/125,406

(22) PCT Filed: Apr. 22, 2010

(86) PCT No.: PCT/US2010/032061

§ 371 (c)(1),
(2), (4) Date: Sep. 14, 2011

(87) PCT Pub. No.: WO2011/133157

PCT Pub. Date: Oct. 27, 2011

(65) Prior Publication Data

US 2012/0109366 A1 May 3, 2012

(51) Int. Cl.

| | |
|---|---|
| ***G06F 17/00*** | (2006.01) |
| ***A47K 10/26*** | (2006.01) |
| ***B65H 43/00*** | (2006.01) |
| ***B65H 16/10*** | (2006.01) |
| ***A47K 10/36*** | (2006.01) |
| ***A47K 10/38*** | (2006.01) |
| *B65H 16/02* | (2006.01) |

(52) U.S. Cl.
CPC ..... *A47K 10/36* (2013.01); *B65H 16/026* (2013.01); *A47K 10/3845* (2013.01)

(58) Field of Classification Search
CPC ..... A47K 10/3845; B65H 16/026
USPC ..... 700/231, 240, 243
See application file for complete search history.

(56) References Cited

U.S. PATENT DOCUMENTS

| | | | | |
|---|---|---|---|---|
| 2,711,860 | A * | 6/1955 | Layton | 242/596.3 |
| 4,620,184 | A | 10/1986 | Nedstedt | |
| 4,666,099 | A | 5/1987 | Hoffman et al. | |
| 4,721,265 | A | 1/1988 | Hawkins | |
| 4,786,005 | A | 11/1988 | Hoffman et al. | |
| 4,790,490 | A | 12/1988 | Chakravorty | |
| 4,796,825 | A | 1/1989 | Hawkins | |
| 4,826,262 | A | 5/1989 | Hartman et al. | |
| 4,960,248 | A | 10/1990 | Bauer et al. | |
| 5,086,526 | A | 2/1992 | Van Marcke | |
| 5,452,832 | A | 9/1995 | Niada | |
| 5,694,653 | A | 12/1997 | Harald | |
| 5,727,579 | A | 3/1998 | Chardack | |

(Continued)

OTHER PUBLICATIONS

PCT International Search Report and Written Opinion (PCT/US2008/080793)—8 pages.

*Primary Examiner* — Michael K Collins
(74) *Attorney, Agent, or Firm* — Boyle Fredrickson, S.C.

(57) ABSTRACT

An automatic product dispenser determines if the roll loaded into the dispenser is approved for use with the dispenser. The core of a roll receives a plug that engages a hub within the dispenser. The plug has a feature that alters an electromagnetic field created proximate the hub. The alteration of the electromagnetic field may then be used to determine if the plug, and thus the roll, is usable with the dispenser.

20 Claims, 12 Drawing Sheets

(56) References Cited

U.S. PATENT DOCUMENTS

| | | | | |
|---|---|---|---|---|
| 5,772,291 | A | 6/1998 | Byrd et al. | |
| 5,963,135 | A | 10/1999 | Van Marcke | |
| 5,984,049 | A | 11/1999 | Lammers | |
| 6,105,898 | A | 8/2000 | Byrd et al. | |
| 6,279,777 | B1 | 8/2001 | Goodin et al. | |
| 6,293,486 | B1 | 9/2001 | Byrd et al. | |
| 6,388,609 | B2 | 5/2002 | Paese et al. | |
| 6,412,655 | B1 | 7/2002 | Stuetzel et al. | |
| 6,412,679 | B2 | 7/2002 | Formon et al. | |
| 6,502,784 | B1 | 1/2003 | Sato | |
| 6,592,067 | B2 | 7/2003 | Denen et al. | |
| 6,631,574 | B2 * | 10/2003 | Okyere | 40/309 |
| 6,695,246 | B1 * | 2/2004 | Elliott et al. | 242/564.1 |
| 6,731,209 | B2 | 5/2004 | Wadlow et al. | |
| 6,736,348 | B1 | 5/2004 | Formon et al. | |
| 6,745,927 | B2 | 6/2004 | Formon et al. | |
| 6,820,785 | B2 | 11/2004 | Kapiloff | |
| 6,838,887 | B2 | 1/2005 | Denen et al. | |
| 6,854,684 | B2 | 2/2005 | Byrd et al. | |
| 6,892,620 | B2 | 5/2005 | Kapiloff | |
| 6,903,654 | B2 | 6/2005 | Hansen et al. | |
| 6,953,171 | B2 | 10/2005 | Takashima | |
| 6,977,588 | B2 | 12/2005 | Schotz et al. | |
| 6,988,689 | B2 | 1/2006 | Thomas et al. | |
| 7,040,566 | B1 * | 5/2006 | Rodrian et al. | 242/563 |
| 7,213,782 | B2 | 5/2007 | Osborne et al. | |
| 7,240,873 | B2 | 7/2007 | Eikmeier et al. | |
| 7,240,874 | B2 | 7/2007 | Eikmeier et al. | |
| 7,264,194 | B2 | 9/2007 | Gassner et al. | |
| 7,306,162 | B2 * | 12/2007 | Forster | 235/492 |
| 7,370,824 | B1 | 5/2008 | Osborne | |
| 7,793,608 | B1 * | 9/2010 | Udouj | 116/200 |
| 8,160,742 | B2 * | 4/2012 | Goerg et al. | 700/240 |
| 8,165,716 | B1 * | 4/2012 | Goeking et al. | 700/237 |
| 8,366,035 | B2 * | 2/2013 | Kling et al. | 242/563 |
| 8,544,785 | B2 * | 10/2013 | Pelland et al. | 242/563 |
| 8,789,787 | B2 * | 7/2014 | Kling et al. | 242/563 |
| 2001/0017309 | A1 | 8/2001 | Formon et al. | |
| 2002/0109035 | A1 | 8/2002 | Denen et al. | |
| 2003/0041716 | A1 | 3/2003 | Takashima | |
| 2003/0167893 | A1 * | 9/2003 | Morris et al. | 83/649 |
| 2003/0189125 | A1 | 10/2003 | Trierenberg | |
| 2005/0006520 | A1 | 1/2005 | Gassner et al. | |
| 2005/0011987 | A1 * | 1/2005 | Lemaire et al. | 242/563 |
| 2005/0145745 | A1 * | 7/2005 | Lewis et al. | 242/563 |
| 2005/0167541 | A1 | 8/2005 | Osborne | |
| 2005/0171634 | A1 * | 8/2005 | York et al. | 700/231 |
| 2005/0237199 | A1 * | 10/2005 | Bellum et al. | 340/572.8 |
| 2006/0006275 | A1 | 1/2006 | Neveu et al. | |
| 2007/0228207 | A1 | 10/2007 | Ikezawa | |
| 2008/0067281 | A1 * | 3/2008 | Zeiron | 242/599.4 |
| 2008/0142632 | A1 * | 6/2008 | Larsson | 242/601 |
| 2009/0314829 | A1 * | 12/2009 | McAllistor | 235/375 |
| 2011/0133010 | A1 * | 6/2011 | Pelland et al. | 242/160.4 |

* cited by examiner

INSERT FOR USE WITH A ROLL OF WEB MATERIAL, AND PROVIDING A UNIQUE IDENTIFIER FOR THE ROLL OF WEB MATERIAL

CROSS-REFERENCE TO RELATED APPLICATION

The present application is a national stage application under 35 U.S.C. §371 of International Application Ser. No. PCT/US2010/032061.

BACKGROUND OF THE INVENTION

The present invention is generally directed to product dispensers and, more particularly, to a dispenser having a lockout feature that prevents the dispensing of product from a non-approved source.

Automatic towel and similar product dispensers have been developed to reduce the waste generally associated with manual dispensers. Automatic dispensers typically include a motor driven drive roller that advances web material, such as hand towel material, from a web material roll. Early automatic dispensers required a user to depress a feed button to activate the drive roller. More recently, automatic dispensers have incorporated proximity sensor technology to allow hands-free or otherwise contact-free activation of the drive roller.

Conventional automatic dispensers advance web material from the web material roll according to predetermined settings that result in the same amount of web material being dispensed regardless of the particular characteristics of the web material to be dispensed. For example, a conventional automatic towel dispenser will advance a fixed amount of web material from a web material roll independent of the absorbency of the web material. As a result, it is possible for too much or too little web material to be dispensed; both of which can lead to waste. When too much web material is dispensed, the excess cannot be retrieved and reused and therefore creates waste. When too little web material is dispensed, a user will often retrigger the dispenser to dispense additional web material possibly resulting in additional waste.

Accordingly, a number of "smart" dispensers have been developed that are able to obtain information about certain characteristics of a web material roll, or the web material wrapped therearound, and adjust the dispensing settings accordingly. One such dispenser is described in U.S. Pat. Pub. No. 2005/0171634. This publication describes a dispenser having a reader or scanner that communicates with an RFID "smart" chip or tag embedded in the core of a roll. The smart chip includes information relating to the type of product to be dispensed. For a roll of hand towel material, that information may include absorbency, basis weight, and manufacturer. The scanner reads this information from the smart chip and communicates that information to a processor that adjusts performance settings accordingly. For example, the feed length may be adjusted based on the information contained in the smart chip. Additionally, the processor may disable the automatic drive or feed components if an unapproved or unrecognized roll is loaded into the dispenser. The automatic drive components may also be disabled if no information is gathered from the smart chip, which may occur when a roll absent a smart chip is loaded into the dispenser. This "lockout" feature is intended to reduce jamming of the dispenser, damage to the dispenser, and/or unsatisfactory dispensing of web material that may result from use of an unapproved or an unrecognized roll.

In addition to significantly adding to the cost of each roll and the dispenser itself by virtue of the necessary reader(s) and circuitry, such smart chips or RFID tags are only effective if the web material of the roll matches the information encoded in the smart tag. If there is a mismatch between the web material and the encoded information, the performance settings of the dispenser will not be tailored to the specifics of the web material to be dispensed. Further, the lockout feature is designed to prevent the use of unauthorized or unrecognized rolls with the automatic dispenser. If there is an inconsistency between the encoded information and the actual web material to be dispensed, the lockout feature may not function properly.

Another "smart" dispenser, which is described in U.S. Pat. No. 7,040,566, uses a bar code-embedded roll and a bar code reader to determine if the roll is from an authorized source before the dispenser is activated to dispense material from the roll. The bar code reader is described as a phototransistor reflective object sensor that reads the bar code associated with a roll loaded into the dispenser and transmits a code signal to a controller that compares the code signal to a set of approved codes maintained in a computer readable database. If the code associated with the code signal does not match an approved code, the dispenser is automatically locked out form dispensing material from the loaded roll.

While such a smart dispenser is believed to be effective in preventing unauthorized rolls from being loaded into a dispenser, the cost and the collective size of the components can result in a significant increase in the overall cost, complexity, and size of the dispenser. For example, such a lockout system requires not only the aforementioned bar code reader/sensor and microcontroller but also an analog to digital converter for digitizing the analog output of the reader.

The above-described systems can also often be circumvented by removing the bar code or RFID tag and placing them on the core of a new roll or merely in appropriate proximity to the reader. The dispenser can then be loaded with an unapproved or unrecognized roll and be caused to operate as if an approved or recognized roll has been loaded. As a result, the waste management, performance and supply control advantages provided by the smart chips or RFID tags may not be realized.

BRIEF DESCRIPTION OF THE INVENTION

The present inventors have found that the advantages provided by smart chips, bar code readers, or RFID tags can be realized while avoiding the pitfalls and costs associated therewith. More particularly, the present invention is directed to an automatic web material dispenser that determines if the roll loaded into the dispenser is approved for use with the dispenser. In one embodiment of the present invention, in order to achieve this result, it compares a baseline system frequency to the frequency after the roll has been loaded into the dispenser and determines if changed frequency is within a predetermined range. If so, then the roll is approved for use with the dispenser and the dispenser is activated. In one embodiment, a plug having a metallic feature is loaded into, and adhesively bonded to an open end of a roll of web material. Bonding the plug to the roll is intended to discourage removal of the plug from the roll and inserting the plug into an otherwise plug-less roll of web material. It is also contemplated that the plug could be press-fit into the open end of the roll and in a manner that would discourage removal of the plug from the roll, i.e., results in damage to the plug and/or roll if the plug was removed. When the appropriate modified frequency is recognized, the system can be set to adjust for various particulars of the web material to be dispensed, such as brand name, type, size, and the like, that can be used to automatically tailor the performance settings of the dispenser.

It is therefore one object of the present invention to provide an automatic product dispenser having a lockout feature that cannot be easily circumvented.

It is a further object of the invention to provide a roll having a recognition device or material that cannot be transferred to other rolls.

Therefore, in accordance with one aspect of the present invention, an apparatus for dispensing product from a roll is disclosed. The apparatus includes a drive roller adapted to advance product from a roll. The roll to be loaded into the dispenser includes a frequency changing device or material that may be indicative of the product carried by the roll or merely the source or provider of the roll. The apparatus further includes a controller associated with the drive roller and adapted to determine the frequency resulting from the presence of the frequency changing device or material of the roll, compare the system base frequency to the changed frequency and then, if the changed frequency matches a predetermined frequency, falls within a predetermined range, or is changed a predetermined amount or percentage, permit the drive roller to advance the product from the roll. If the changed frequency does not match the predetermined frequency, shift or range, then the drive motor will not be actuated, thereby preventing the dispensing system from operating to advance product from the roll.

In accordance with another aspect, the present invention includes a method of regulating product dispensing from a dispenser. The method includes determining if a roll includes a frequency shifting device or material that fits the predetermined profile. If it does, then the dispensing particulars of the roll can be known and/or set.

According to another aspect, the present invention includes a plug for insertion into an open end of a roll of web material for use with an automatic dispensing device. The plug has a metallic feature operative as a frequency shifting device for identifying a brand or source of the roll associated therewith.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings:

FIG. 12 is a schematic view of a control circuit associated with the product discriminating assembly.

DETAILED DESCRIPTION OF THE INVENTION

The present invention will be described with respect to an automatic towel dispenser for dispensing web material, but it is recognized that the invention is applicable to automatic dispensers adapted to automatically dispense other types of products, including other paper and non-paper products. Additionally, the invention is applicable with touch-based and touchless automatic dispensers, such as those commercially available from The Colman Group, Inc. of Elkhorn, Wis.

As will be explained in greater detail further below, the present invention is generally directed to a dispenser, such as a paper towel dispenser, that includes circuitry for generating an electromagnetic field generally around a roll mount. When an authorized roll is mounted onto the roll mount, the roll will cause a change in the frequency of the electromagnetic field. More particularly, the circuitry includes a frequency generator (oscillator) and a coil for creating the electromagnetic field and the roll includes a uniquely constructed closed loop. Thus, when the roll is loaded into the dispenser, the frequency generator will generate a new waveform having a changed frequency reflective of the mutual inductance between the coil and the closed loop. The new waveform, or one or more characteristics thereof, are the result of the properties of the closed loop. The new waveform, or some form thereof, may then be analyzed to determine if the roll loaded into the dispenser is authorized for use with the dispenser. If so, the dispenser will dispense material from the roll. If not, the dispenser will be locked out and will not operate thereby preventing unintended or impermissible use of the dispenser.

Figure 1:
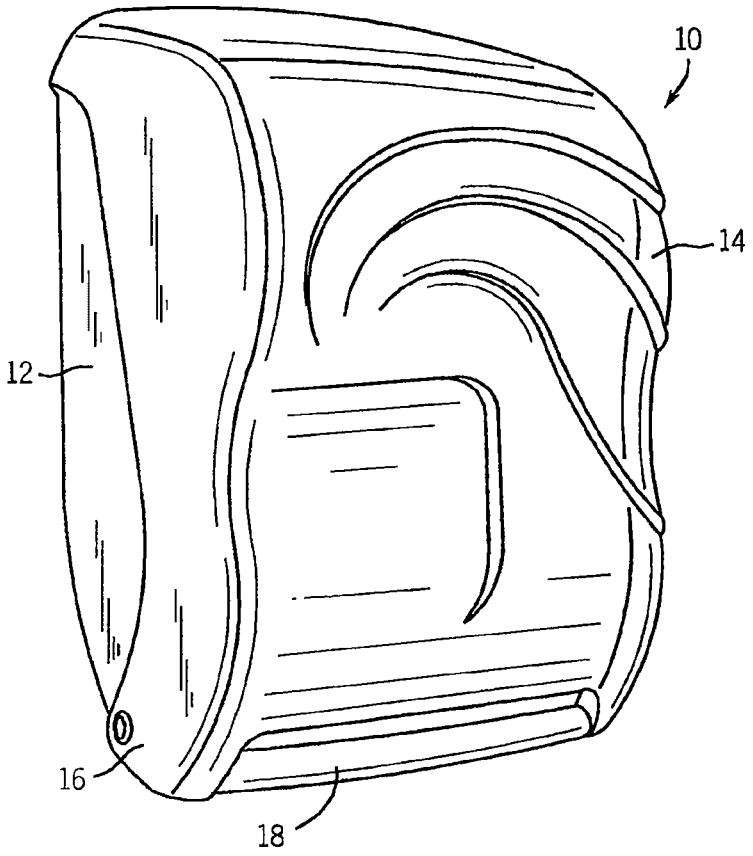
FIG. 1 is an isometric view of an automatic towel dispenser.

An exemplary paper towel dispenser is shown in FIG. 1. Automatic towel dispenser 10 includes a back cover 12 designed to be wall-mounted and a front cover 14 coupled to the back cover 12 by a hinge 16. Paper towel or web material is fed from a web material roll (not shown) contained within the automatic towel dispenser 10 through dispensing slot 18 by a drive assembly 20, shown in FIG. 2. The clamshell design of the automatic towel dispenser 10 allows a roll to be loaded into the automatic towel dispenser 10 by unlocking the front cover 14 from the back cover 12 in a known manner and then rotating the front cover 14 downwardly about hinge 16.

Figure 2:
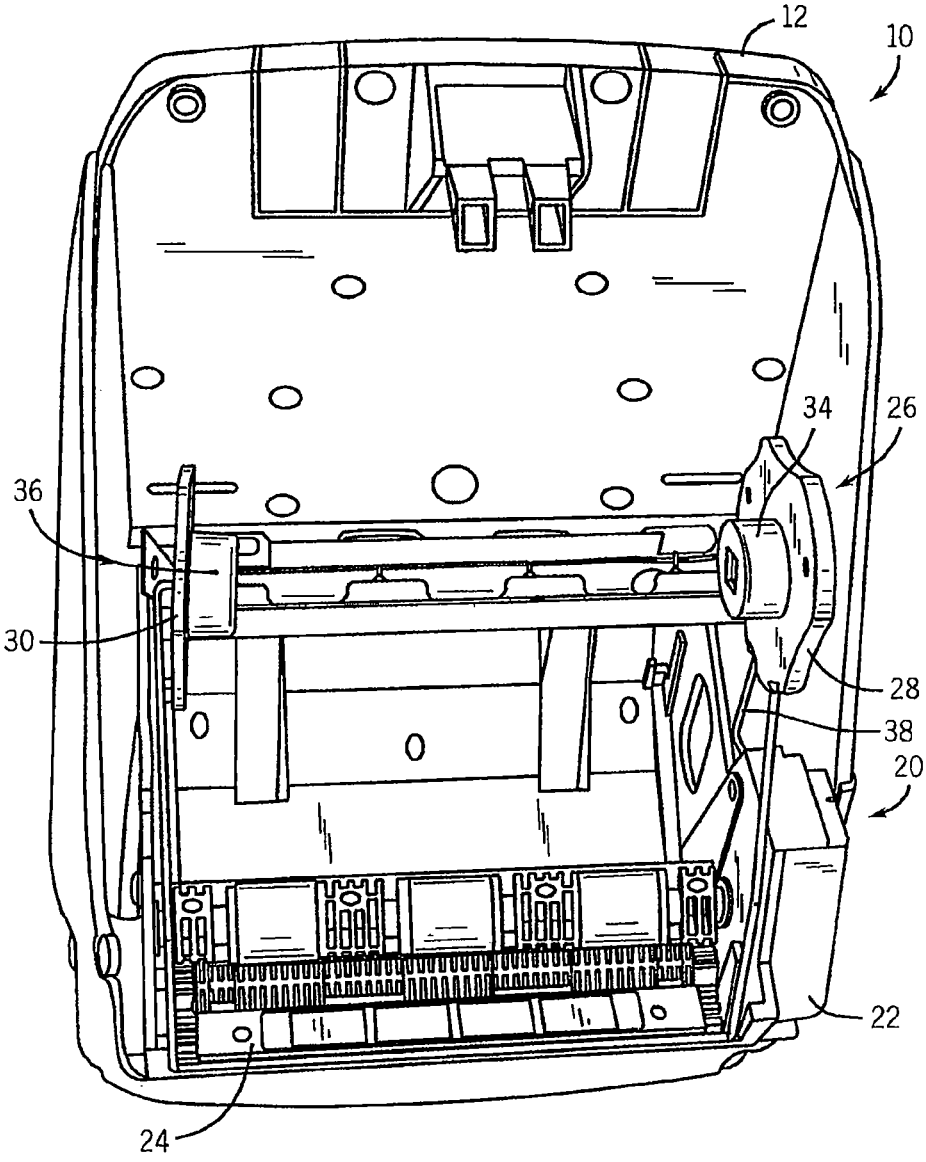
FIG. 2 is a front elevation view of the automatic towel dispenser of FIG. 1 with the front cover removed.

As shown in FIG. 2, drive assembly 20 is mounted to the back cover 12 and includes a PC board and motor contained within housing 22 and operatively associated, in a known manner, with a drive roller assembly 24. The drive roller assembly 24 is designed to grab and forcibly advance web material from a roll of web material (not shown) through dispensing slot 18. The drive roller assembly 24 may be of conventional design, such as that described in U.S. Pat. No.

7,168,653, the disclosure of which is incorporated herein by reference. As will be described in greater detail below, the motor may be controlled by a processor adapted to smartly control operation of the motor and drive roller assembly, including, when appropriate, disablement of the motor so as to lock out its functionality when an unapproved roll is loaded into the automatic towel dispenser 10.

Figure 3:
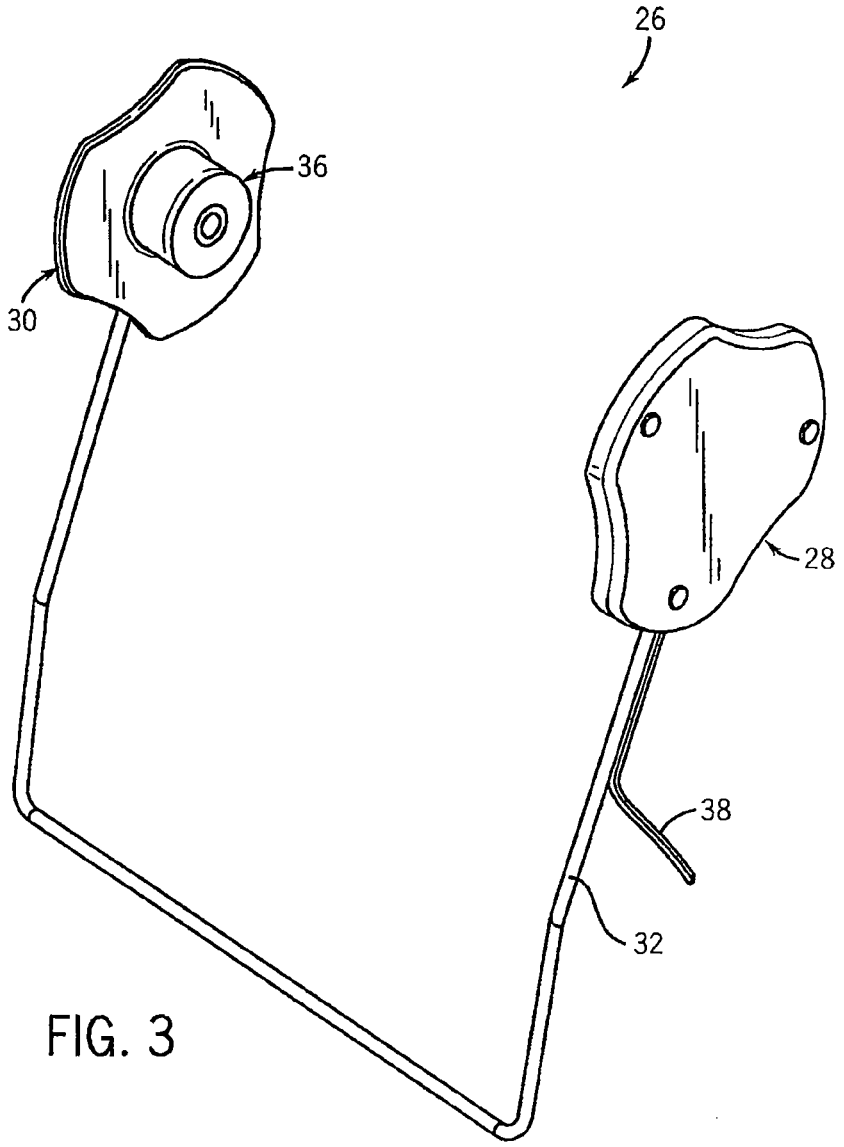
FIG. 3 is an isometric view of a roll carrier assembly for use with the automatic towel dispenser of FIGS. 1-2.
Figure 4:
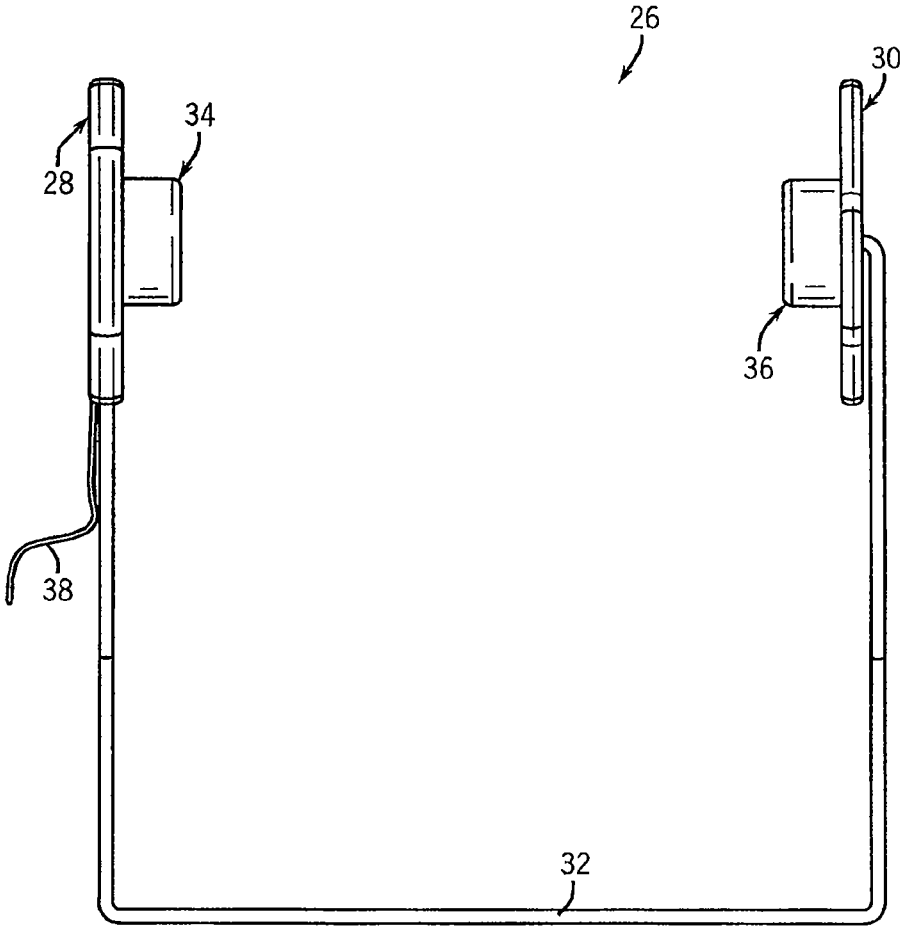
FIG. 4 is front elevation view of the roll carrier assembly shown in FIG. 3.

In one embodiment of the present invention, a continuous sheet of web material is advanced from a roll (not shown) that is preferably mounted on a carrier assembly 26 of the type that includes a pair of roll support plates 28, 30 that carry a guide wire 32, as shown further in FIGS. 3-4. Each support plate 28, 30 has an inwardly facing hub 34, 36, respectively, that is designed to extend partially through the hollow core of the roll. The hubs 34, 36 have a generally circular cross-section to match that of a plug that is inserted into the hollow core of the roll. As will be described more fully below, the plug provides two generally functions. It is used to mount the roll in the dispenser, and more particularly to hub 34, and includes a metallic member that modifies the waveform emitted by a coil contained in hub 34. As further shown in FIG. 2, a wire 38 extends from the hub 34 to an oscillator within housing 22. As will be explained, the oscillator and a coil create an electromagnetic field generally about the hub 34.

Figure 5:
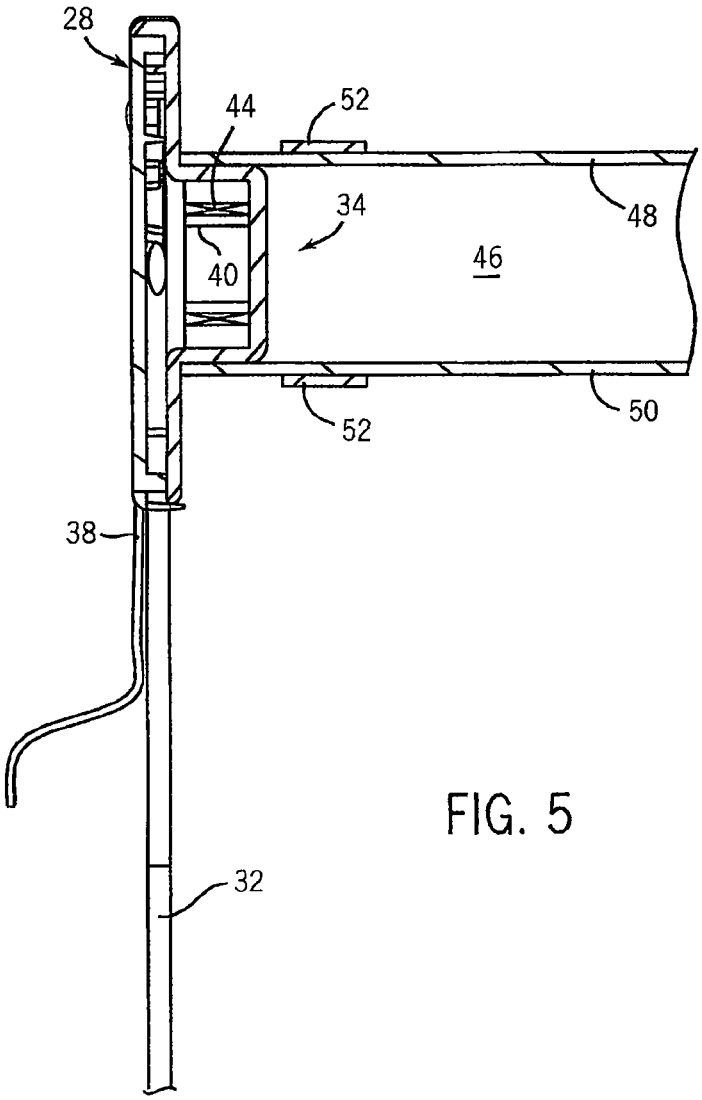
FIG. 5 is a section view of a portion of the roll carrier assembly shown in FIGS. 3 and 4.

Referring to FIG. 5, the hub 34 provides a housing for a bobbin 40 around which a coil (wire winding) 44 may be wrapped. When the coil 44 is energized, an electromagnetic field is generated. As noted above, the hub 34 is received by one end of the hollow core 46 of the roll. The core 46 has an inner surface 48 and an outer surface 50. The outer surface 50 is impregnated or otherwise carries a continuous ring of conductive material 52. Alternately, the conductive material 52 could be placed on the inner surface 48, or both the inner and outer surfaces 48, 50, or impregnated in the core material. In the illustrated embodiment, the conductive material 52 is arranged in the form of a ring that envelopes a portion of the outer surface 50 of the core 46. The conductive ring of material 52 (or alternatively, a closed circuit (not shown) or other type of closed loop) is designed to modify the base system frequency as it interacts with the electromagnetic field of the coil. For example, the conductive material 52 for a given core may include one or more of copper, gold, nickel and silver. The width, thickness, purity, type and location of the conductive material can affect the degree of frequency shift or change. In one embodiment, the amount of frequency changing device or material can be used to identify the brand of the roll.

In one embodiment, the closed loop 52 is formed as a ring of conductive material around a portion of a roll core 46. It is recognized, however, that in alternate embodiments, the closed loop 52 may be arranged in other patterns to uniquely identify the roll. For example, multiple rings of conductive material 52 could be used. In one embodiment, one type of conductive material 52 is used, but it is recognized that mixtures of various types of conductive material 52 could be used. Regardless of the contents of the conductive material 52 and how it is placed on the roll, the resulting frequency can uniquely identify the brand, source, or some other defining characteristic of the roll so that a determination can be made as to whether the roll may be used with the automatic towel dispenser 10. The resulting frequency may also identify the type of material, the size of the roll, and other parameters that may be useful in establishing operating parameters for the automatic towel dispenser 10.

Figure 6:
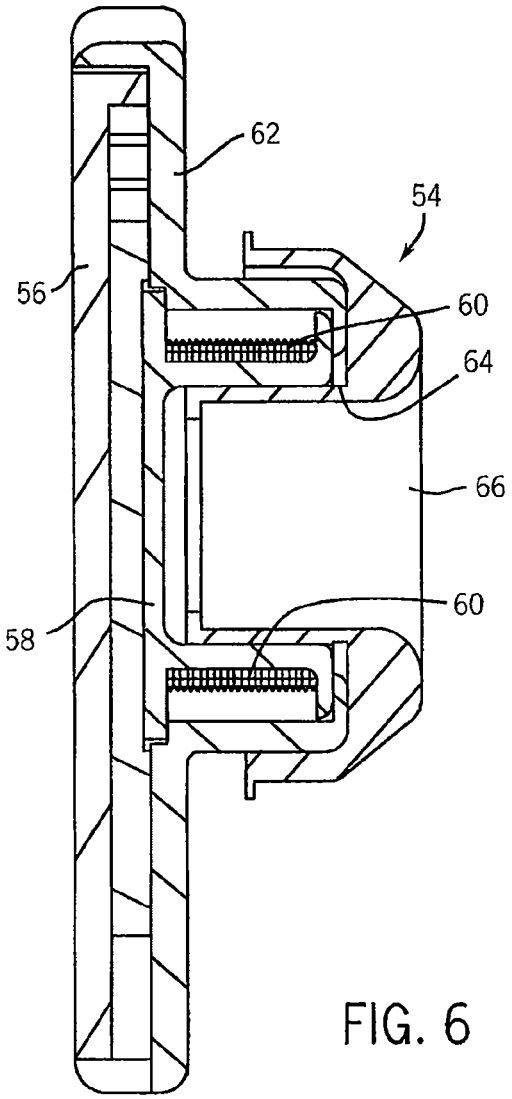
FIG. 6 is section view of a hub assembly according to another embodiment of the invention.
Figure 7:
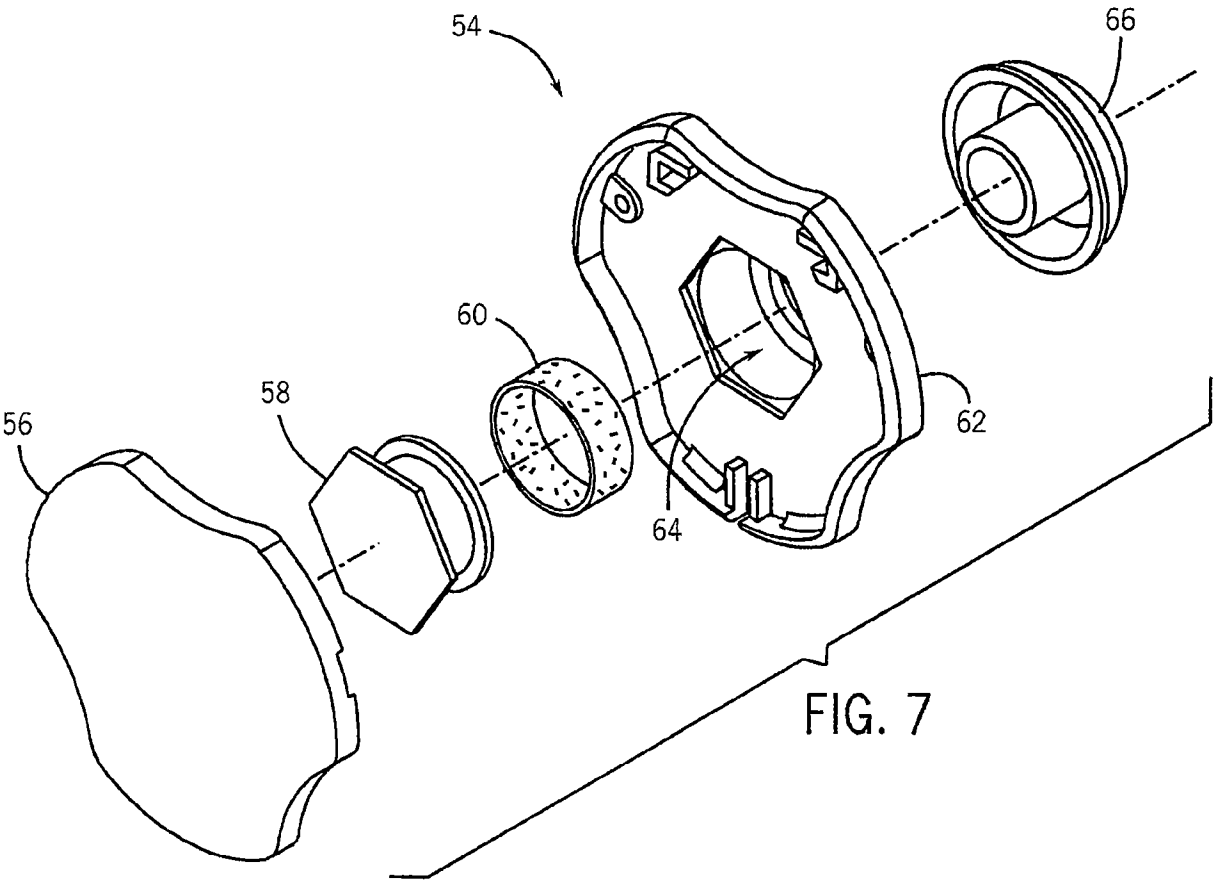
FIG. 7 is an exploded view of that shown in FIG. 6.

FIGS. 6 and 7 show a hub assembly 54 according to another embodiment of the invention. Hub assembly 54 includes a support plate 56 to which a bobbin 58 is affixed in a known manner. A coil winding 60 is mounted to the bobbin 58, and a cover 62 having an opening 64 fits over the bobbin 58 and thus coil 60. An end cap 66 snaps into or is otherwise retained by the bobbin 58. The end cap 66 fits within the hollow core of the roll. In one embodiment, the shape of the end cap 66 and the core of the roll are matched such that rolls having cores with non-complementary shapes cannot be used with the dispenser.

Figure 8:
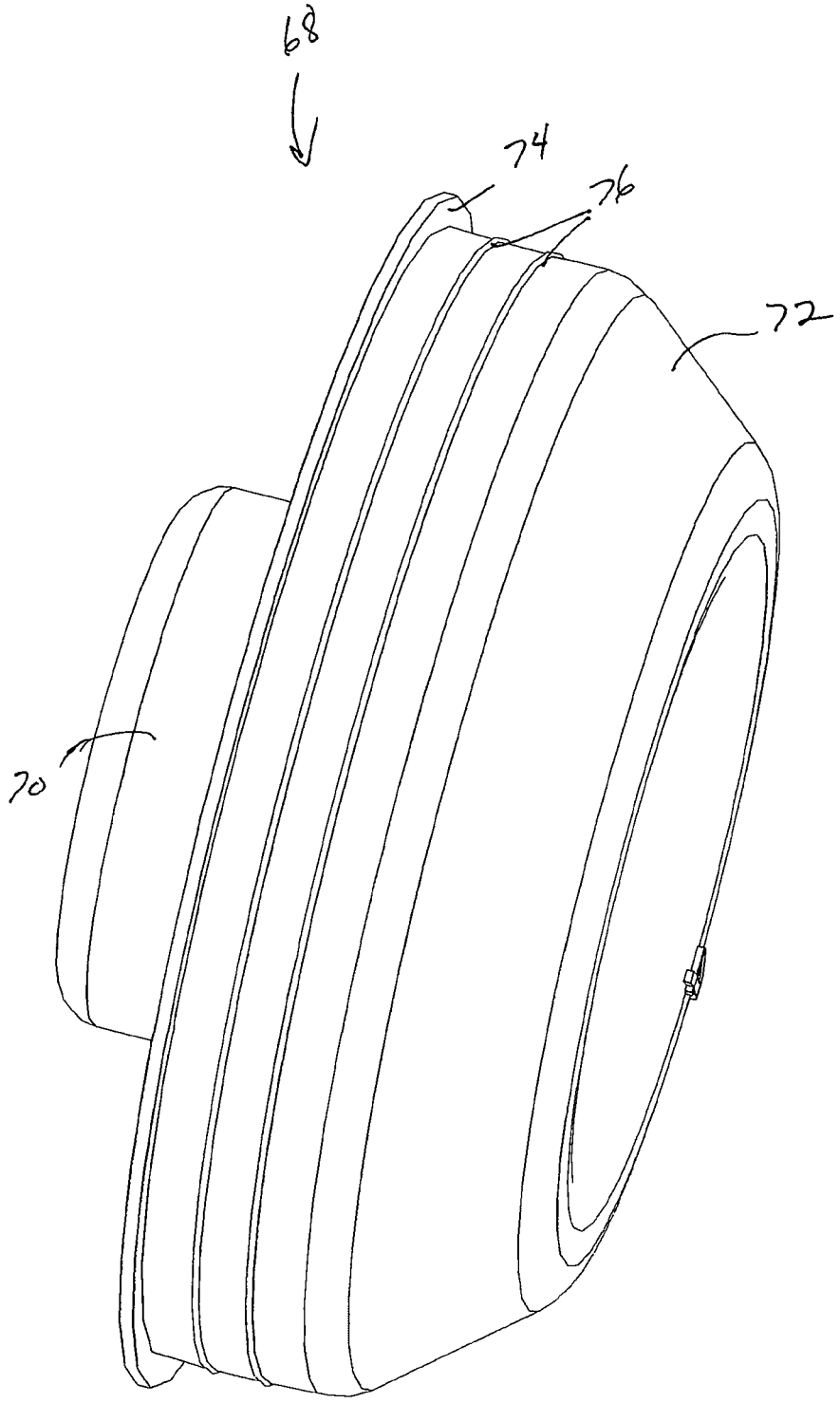
FIG. 8 is an isometric view of a plug according to another embodiment of the invention and used to connect a roll web material to the hub assembly of FIGS. 6 and 7.

In another embodiment of the invention, a conductive member is loaded into a plug that is used to mount a roll of web material to the hub. As shown in FIG. 8, plug 68 is similar in outward appearance to the end cap 66 shown in FIGS. 6 and 7. More particularly, the plug 68 has a generally cylindrical shaped stem 70 and a rounded cap 72 preferably integrally formed with the stem 70. In one embodiment, the stem 70 is shaped to be complimentary with the opening formed in the bobbin 58. In this embodiment, the complimentary engagement surfaces of the stem 70 and the bobbin 58 prevent the stem from being loaded improperly into the bobbin or used with an unmatched bobbin. An annular ridge 74 is formed with the cap 72 and provides a seat for the roll of web material when the roll is loaded onto the plug 68. Spaced from the ridge 74 are a set of radial edges 76 that are used to "grip" the core of the roll.

Figure 9:
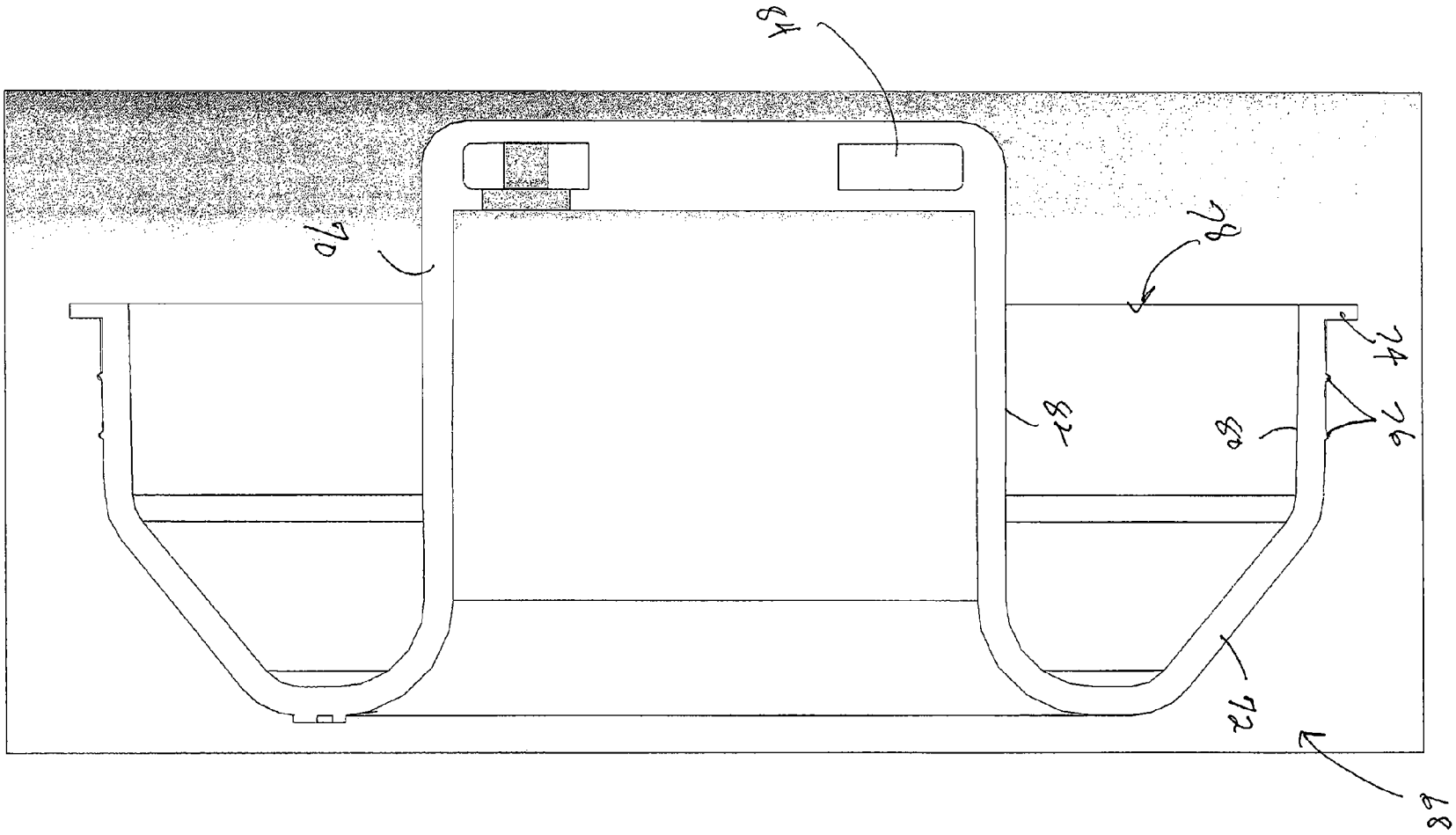
FIG. 9 is a section view of the plug of FIG. 8.
Figure 9A:
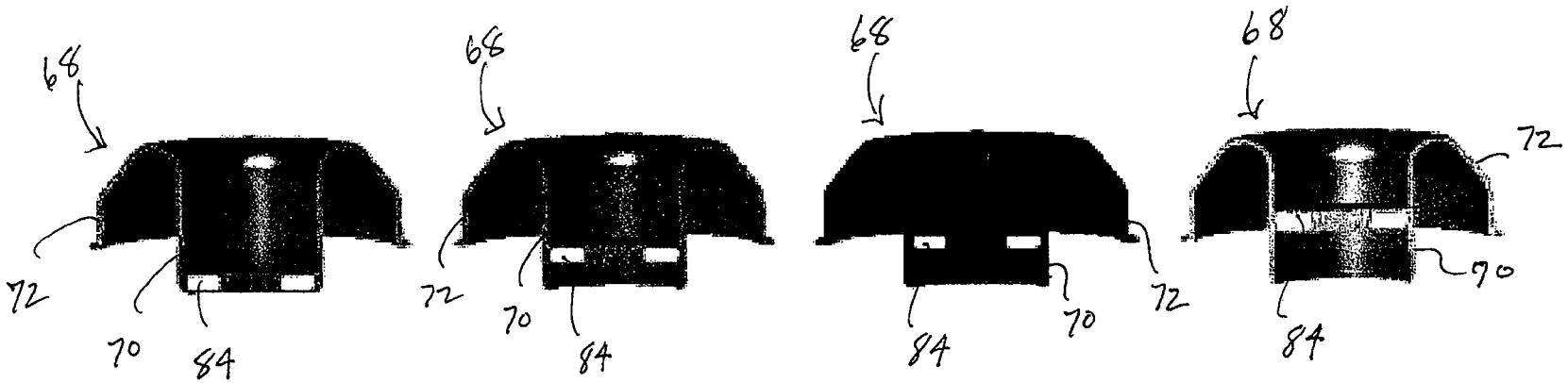
FIG. 9A shows placement of a conductive ring at various positions within the plug of FIG. 8.

As shown in FIG. 9, the stem 70 and the cap 72 are formed as a single unitary structure so that an annular recess 78 is provided between the inner surface 80 of the cap 72 and the outer surface 82 of the stem 70. This construction allows the plug 68 to be inserted into the opening in the bobbin 58 in a manner that seats the stem 70 within the core of the coil winding 60. In the embodiments of the invention described above, conductive material was incorporated into the roll of web material, such as a conductive ring formed with the roll core. In this alternate embodiment, the plug 68 contains conductive material that interacts with the electromagnetic field generated by the coil 44 to provide a "handshaking" between the dispenser and the roll of web material. While inclusion of the conductive material in the plug 68 may take many forms, such as embedded pieces of conductive material randomly displaced throughout the stem and/or cap, in one embodiment, a metallic ring 84 is loaded into the stem 70. In a low cost version of the present invention, the metallic ring 84 is a simple metal washer. In a preferred embodiment, the metallic ring 84 is insert molded with the stem 70 and cap 72. As shown in FIG. 9A, for example, the metallic ring 84 can be molded, or otherwise positioned, at one of multiple positions within the stem 70 to define the inductive signature of the plug. It will be appreciated that in addition to position, the type of metal and the mass of the metal will impact how the ring 84 interacts with the electromagnetic field generated by the coil 44. In this regard, it is understood that the position of the ring 84, its size, and its material composition may be selected to provide a unique signature or marker for the plug 68 and thus the roll associated with the plug 68. It will also be appreciated that a plug may have more than one conductive insert, e.g., metallic ring, to define its inductive signature. Further, it will be appreciated that the conductive element may take a different shape or form than that illustrated herein. For example, the stem may include recesses that are loaded with conductive rods or pins to define the inductive signature for the plug.

In the embodiment shown in FIG. 9, the metallic ring 84 is insert molded with the plug 68 and thus is encased within the plug 68. Integrally forming the ring 84 with the plug 68 locks the "identity" of the plug and prevents the ring 84 from being removed from the plug without destroying the plug itself. Preferably, the plug and the bobbin (or some other element of the hub assembly) are color coded so that the plug and hub assembly are matched to one another.

Figure 11:
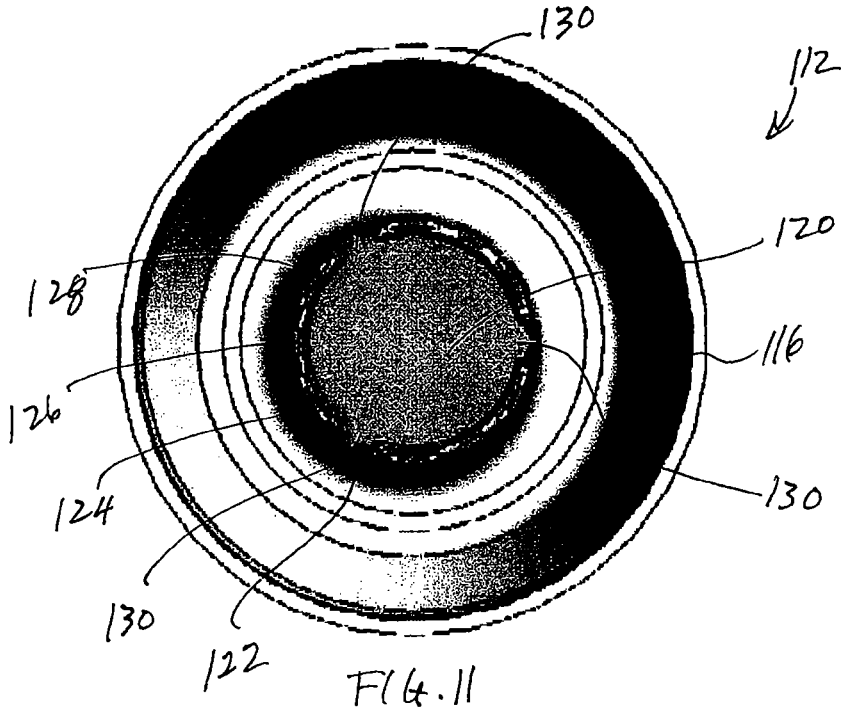
FIG. 11 is a top plan view of the plug of FIG. 10.
Figure 10:
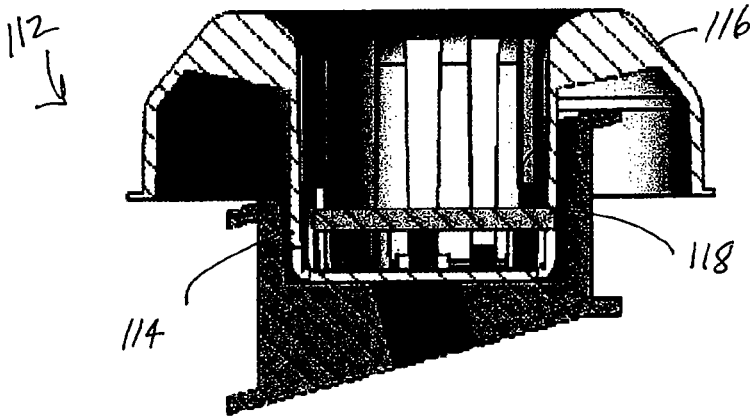
FIG. 10 is a section view of a plug according to another embodiment of the invention.
Figure 10:
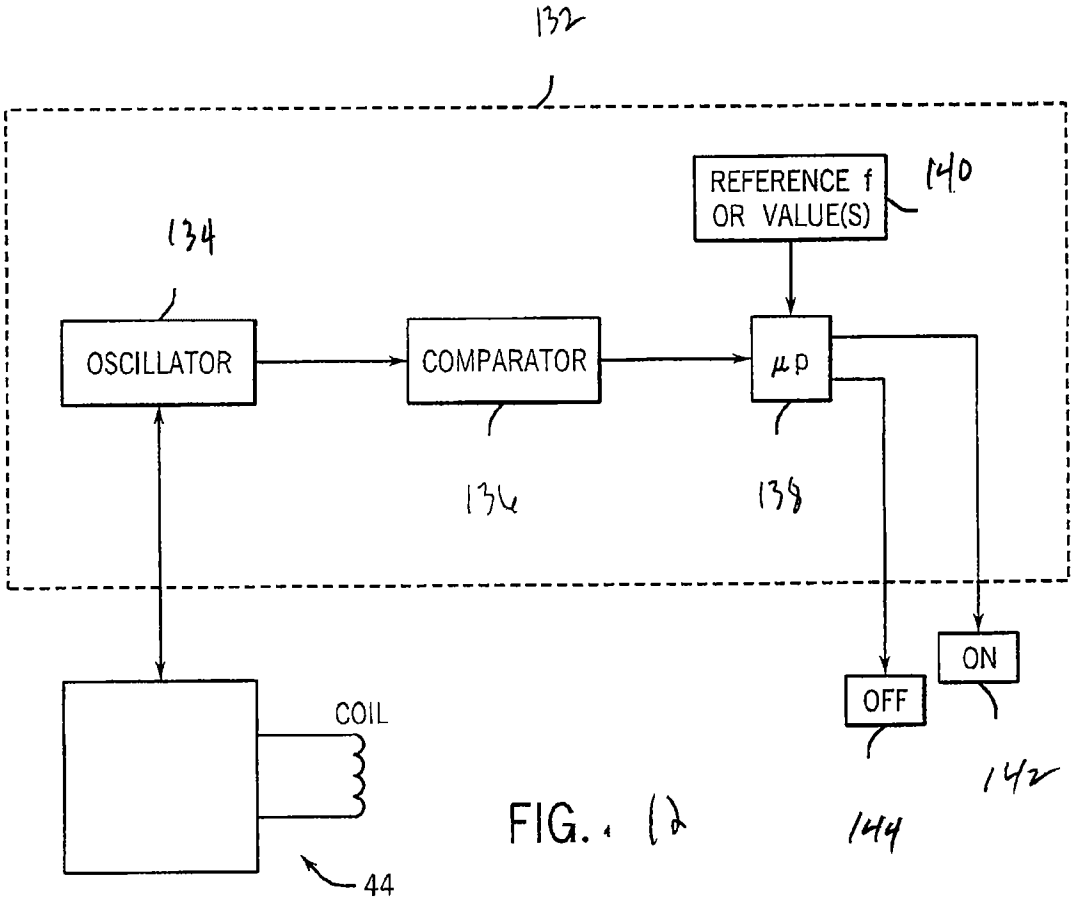

Another embodiment of the invention is shown in FIGS. 10 and 11. Plug 112 has a stem 114 and a head 116. The stem 114 has a generally hollow interior defined by an annular surface 118. The interior surface 118 is stepped that allows a keyed plastic insert 120 encasing a conductive element (not shown) to be drop-set at different depths within the stem 114. In a preferred embodiment, four different sets of keyways 122, 124, 126, 128 are formed along the interior surface 118 of the stem 114 and radially spaced from one another to define four different depths at which the plastic insert 120 may be positioned. Each set of keyways preferably includes three keyways to match the three keys 130 formed along an outer radial edge of the plastic insert 120. In one embodiment, the plastic insert 120 is sonic welded or otherwise fixed in place after the plastic insert 120 is set to the desired depth so that the position of the insert 120 cannot be altered. For example, the insert 120 could be snap-fit into place within the stem 114.

As referenced above, and illustrated in FIG. 9A, the position of the plastic insert 120 could be changed to modify the effect the metallic member contained within the insert 120 has on the electromagnetic field emitted by the coil. For example, in combination with the conductive properties of the conductive member, each depth setting could be used to tailor certain operating parameters of the drive roller assembly, such as advancement length. This would allow the advancement length to be set for a given roll by changing the position of the insert within the stem of the plug. In yet a further embodiment, the plastic insert and the bobbin (or exposed article of the hub assembly) are color coded. Color coding these components provides a visual reminder to an installer that the insert 120 for the plug must correspond to the color of the bobbin to ensure proper operation when the plug, and roll, are loaded.

Additionally, it will be appreciated that the plug could be secured or coupled to the roll in a number of ways. For example, the plug could be adhesively bonded to an open end of a roll of web material. Bonding the plug to the roll is intended to discourage removal of the plug from the roll and inserting the plug into an otherwise plug-less roll of web material. In a similar manner, the plug could be press-fit into the open end of the roll and in a manner that would discourage removal of the plug from the roll, i.e., results in damage to the plug and/or roll if the plug was removed.

As shown in FIG. 12, the system of the present invention includes a control logic circuit 132 which includes an oscillator 134 which together with coil 44 generates an electromagnetic field proximate the coil 44 and thus a roll positioned over the hub 34. The oscillator 134 and the coil 44 generate the electromagnetic field at a predetermined frequency which establishes a base system frequency. When a roll having an inductive element, e.g., a ring of conductive material or a plug having a conductive element, associated therewith is brought into proximity of coil 44, preferably by mounting the roll on the hub 34, the mutual inductance between the coil 44 and the inductive element will cause the oscillator to generate a waveform of a different frequency than that of the base system frequency. The output of the oscillator, i.e., waveform, is input to a frequency sampler 136 (e.g., an op-amp, logic gate, comparator, etc.) which effectively determines the frequency of the new waveform generated by the oscillator. The frequency, in effect, is representative of the mutual inductance generated by placement of the roll onto the hub or insertion of the plug into the bobbin. A microprocessor 138 analyzes the output of the comparator and, more particularly, compares the frequency, or some characteristic value thereof, to a reference value 140. The reference value corresponds to a value indicative of an authorized roll. In this regard, the microprocessor 138 includes, or access memory, containing one or more reference values representative of various authorized roll types, brands, etc.

It will be appreciated that the aforementioned comparison can take many forms. For example, the comparison can be done by measuring the percent of change of the mutual inductance relative to the system frequency, i.e., output of the oscillator before the roll is placed on or proximate the hub. If the comparison yields a match against the reference, the control logic circuit energizes the system enabling the drive motor to drive the drive roller and dispense web material, as indicated by block 142. If there is no match, the system is not energized and no material can be dispensed, as represented by block 144. The automatic towel dispenser 10 may include an indicator LED, for example that is illuminated when the lockout feature is activated.

If an unauthorized roll core or plug is loaded on the carrier assembly, the measured frequency or other value will not match the reference frequency or value thus indicating that an unauthorized roll or plug has been loaded on the carrier. It is recognized that the web material dispenser 10 may be adapted to drive multiple types of rolls. Thus, in one preferred embodiment, the automatic dispenser includes a database that is loaded with multiple reference frequencies or values. It is further contemplated that suitable diagnostic tools may be used to provide in-field updates to the database.

A number of embodiments are contemplated for providing the closed loop on or in association with the roll of web material in order to provide a means to cause a frequency change in accordance with the present invention. In a first embodiment, a roll core is coated or impregnated with at least one ring of conductive material. The core can be coated on the inside, on the outside or have the conductive material impregnated somewhere between the inside and outside of the core. In a second embodiment, an insert is provided which can be removed or permanently placed inside the core. The insert can be in the form of a plastic or paperboard plug that includes a ring of conductive material or other closed loop. In a third embodiment a label in the form of a ring impregnated with conductive material can be affixed to the side of the roll of web material. In a fourth embodiment, the web material itself can be coated or impregnated with conductive material to form a ring giving the appearance of, for example, a colored stripe used to indicate the end of a roll of register tape. In the fifth embodiment, a removable paper or other band coated or impregnated with a conductive material that encircles the roll of web material at the time of mounting of the web material in the dispenser could be used. In such case, the band would be removed prior to threading the dispenser for feeding the dispenser, but after the activation of the dispenser had occurred. In this embodiment, upon activation, the dispenser would preferably be set up to dispense an amount of a paper commensurate with that on the roll, prior to reactivation.

Figure 13:
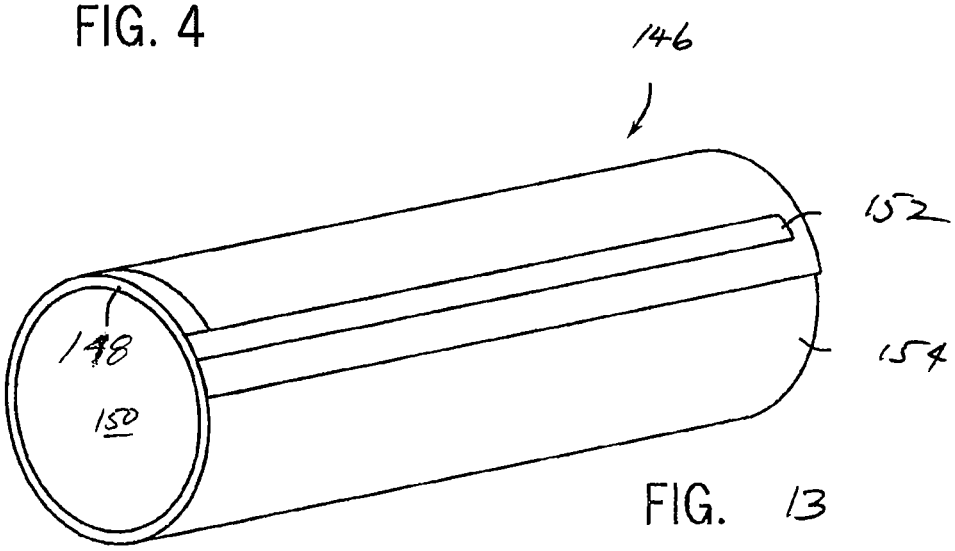
FIG. 13 is a perspective view of paper towel core according to another embodiment of the present invention.

In yet a further embodiment, and with reference to FIG. 13, a web material roll 146 has a core 148 that is partially treated with conductive material, such as ring 150. Glue or similar adhesive 152 is then used to secure the tail 154 of web material to the exterior surface of the core 148. The adhesive 154 is applied so as to overlay the ring 150 of conductive material. This allows the conductive ring 150 to be damaged when the tail 154 of web towel material is pulled from the core 148. Thus, the frequency altering effect of the core will no longer result in match with the reference frequency or value. This prevents the core from being re-loaded with web material not designed to be dispensed by the dispenser. In one preferred embodiment, the ring 150 includes conductive material that is applied as paint to the outer surface of the core 148. Alternately, the conductive material could be sprayed, rolled, or stamped on the core. Also, electro-static techniques could be used to apply the conductive material. In yet another example, the core could be dipped in conductive paint or other fluid or even impregnated in the adhesive used to attach to roll tail.

Additionally, while the invention has been described with respect to a web material dispenser that advances a continuous sheet of paper towel from a roll, it is contemplated that the present invention may be used with web dispensers that dispense other types of paper products, such as toilet paper, and tissue papers. Coreless rolls and dispensers without support hubs may be used with the present invention. Further, the present invention may be used with non-paper dispensers.

Many changes and modifications could be made to the invention without departing from the spirit thereof. The scope of these changes will become apparent from the appended claims.

We claim:

1. A method of regulating product dispensing from a dispenser, the method comprising:

selecting a plug that removably interacts with an electromagnetic field created by a field generator of a dispenser to be inserted into an open end of a rolled product, wherein the plug comprises a stem and a cap extending from the stem and wherein a metallic ring is mounted within at least one of the stem and cap;

inserting said plug into an open end of the rolled product;

creating an electromagnetic field having a characteristic frequency proximate the plug when the rolled product with the inserted plug is mounted in the dispenser;

detecting a change to the characteristic frequency, the change created by the presence of the metallic ring associated with the plug as a function of a position of the metallic ring mounted in the plug, independent of the position of the plug relative to the rolled product;

comparing the changed frequency to a verification frequency; and enabling motorized advancement of the rolled product if the changed frequency substantially matches the verification frequency.

2. The method of claim 1 wherein creating the electromagnetic field includes driving an oscillator to feed a signal having the characteristic frequency to a coil proximate the plug.

3. The method of claim 2 further comprising controlling a drive motor to advance the product a predefined amount based on the changed frequency associated with the plug.

4. The method of claim 2 further comprising determining a roll brand from the changed frequency.

5. The method of claim 4 further comprising determining a roll type, or a roll size, from the changed frequency.

6. The method of claim 1, wherein the change to the characteristic frequency is created by at least one of a position of the metallic ring relative to the electromagnetic field, a size of the metallic ring, and a material composition of the metallic ring.

7. The method of claim 1, wherein the plug comprises a plastic covering the metallic ring.

8. The method of claim 1, wherein the plug is color coded relative to a portion of the dispenser.

9. The method of claim 1, wherein the inserting step further comprises bonding the plug to the open end of the rolled product with an adhesive.

10. The method of claim 1, wherein the inserting step further comprises press fitting the plug to the open end of the rolled product.

11. The method of claim 1, wherein the metallic ring is mounted within the plug at one of a number of predetermined positions to cause a predetermined change to the characteristic frequency.

12. The method of claim 1, wherein said plug is selected such that the material of the metallic ring causes a predetermined change to the characteristic frequency.

13. The method of claim 1, wherein said plug is selected such that the size or shape of its metallic ring causes a predetermined change to the characteristic frequency.

14. A plug to be inserted into a rolled product having a first open end, the plug comprising:

a stem;

a cap coupled to the stem and extending therefrom; and a metallic ring mounted within at least one of the stem and the cap of the plug, the stem and cap being configured to removably cooperate with a bobbin of a dispenser to set the position of the metallic ring relative to the bobbin at a predetermined position along a rotational axis of the plug, wherein the predetermined position of the metallic ring relative to the bobbin corresponds to a unique signature that corresponds to a predetermined change in an electromagnetic frequency when the rolled product associated with the plug is associated with the bobbin.

15. The plug of claim 14, wherein the stem and cap are integrally formed with one another.

16. The plug of claim 14, wherein the cap comprises an annular ridge configured to provide a seat for the rolled product.

17. The plug of claim 16, further comprising a plurality of radial edges spaced from the annular ridge.

18. The plug of claim 14, further comprising an annular recess provided between an inner surface of the cap and an outer surface of the stem.

19. The plug of claim 14, wherein the metallic ring is configured to provide a unique signature associated with the plug based on at least one of a position of the ring, a size of the ring, and the material composition of the ring.

20. A plug configured to interact with an electromagnetic field having a characteristic frequency, the plug comprising:

a first end shaped to substantially fix the plug in a core of a roll of web material at predetermined position of various available positions within the core;

a second end shaped to fit in or on a hub associated with a dispenser and on which the web material is to be mounted for dispensing such that the plug removably cooperates with the hub and is disposed the core of the roll of web material and the hub; and at least one metallic ring of a predetermined shape, fixedly mounted in or on the plug at one of a plurality of preselected positions, configured to alter the characteristic frequency of an electromagnetic field in a known manner as a function of the selected position of the at least one metallic ring relative to the plug.

* * * * *